US005238155A

United States Patent [19]

Blake, III

[11] Patent Number: 5,238,155

[45] Date of Patent: Aug. 24, 1993

[54] FOAM GENERATING DEVICE

[75] Inventor: Joseph W. Blake, III, New Canaan, Conn.

[73] Assignee: Jack W. Kaufman, Merrick, N.Y.

[21] Appl. No.: 653,255

[22] Filed: Feb. 11, 1991

[51] Int. Cl.[5] ..... B67D 5/58

[52] U.S. Cl. ..... 222/190; 222/195; 222/399; 222/400.7; 222/4; 239/343; 239/434

[58] Field of Search ..... 222/190, 195, 394, 399, 222/400.7, 4; 239/343, 434; 169/9, 14, 15, 71

[56] References Cited

U.S. PATENT DOCUMENTS

| | | | |
|---|---|---|---|
| 3,422,993 | 1/1969 | Boehm et al. . | |
| 3,471,064 | 10/1969 | Micallef | 222/190 |
| 3,985,271 | 10/1976 | Gardner | 222/190 |
| 4,018,364 | 4/1977 | Wright | 222/190 |
| 4,022,351 | 5/1977 | Wright | 222/190 X |
| 4,027,789 | 6/1977 | Dickey | 222/190 |
| 4,044,923 | 8/1977 | Gardner | 222/190 |
| 4,318,443 | 3/1982 | Cummins | 169/15 |
| 4,432,496 | 2/1984 | Ito | 222/190 X |
| 4,901,925 | 2/1990 | Blake, III | 222/190 X |
| 4,991,779 | 2/1991 | Blake, III | 222/190 X |
| 4,993,599 | 2/1991 | Gruenewald | 222/190 |

*Primary Examiner*—David H. Bollinger

*Attorney, Agent, or Firm*—Lackenbach Siegel Marzullo & Aronson

[57] ABSTRACT

A foam producing device for the alternative dispensing of foams or liquids comprising a porous element comprising a partially gas permeable wall, a gas distribution plenum, a gas entry port in fluid connection with said plenum; a second wall opposite the outer surface of said gas permeable wall; a mixing chamber comprising at one end, the proximal end, a small annular opening between said gas permeable and second wall, comprising an orifice for the uniform distribution of foamable liquid therethrough into said chamber and at the distal end an exit port for the discharge of foams or liquids from said chamber said chamber being tapered, or not, as required; a liquid distribution plenum for the uniform distribution of said foamable liquids to said orifice and a liquid entry port in fluid connection, through a conduit, with said plenum wherein said plenum and a source of foamable liquid are in fluid connection through a conduit therebetween; with the proviso that only the portion of said gas permeable wall between said orifice and said exit port is gas permeable said device further comprising, in the conduit between the pressurized gas source and said gas distributing plenum valve means to prevent entrance of said gas to said device when only the dispensing of liquid is desired.

37 Claims, 16 Drawing Sheets

FIG. 9
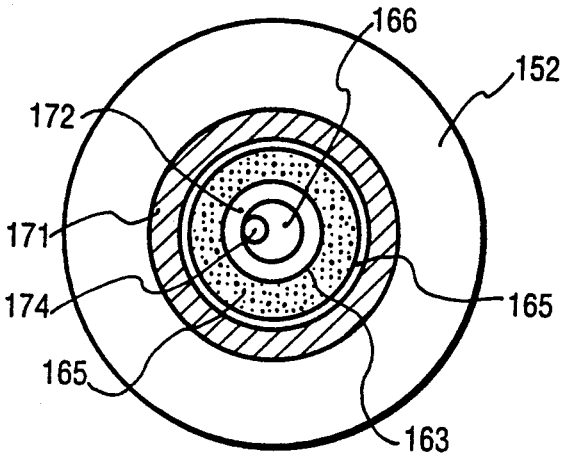
FIG. 10
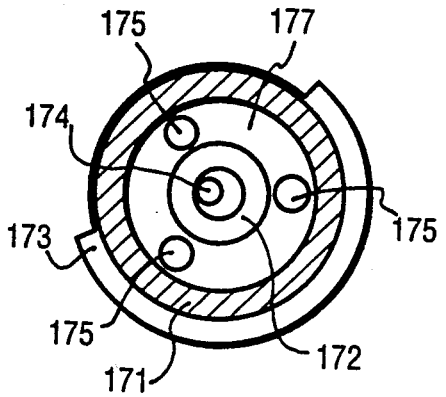
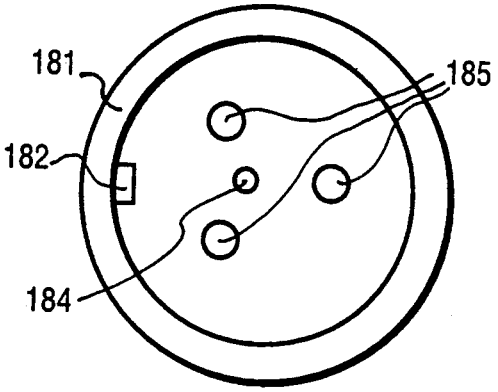
FIG. 11
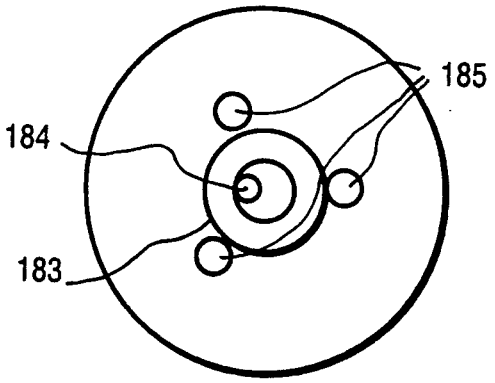
FIG. 12
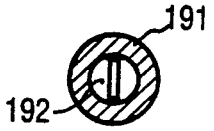
FIG. 13

FOAM GENERATING DEVICE

BACKGROUND OF THE INVENTION

This invention relates to devices for dispensing foams formed by admixing compatible and biologically acceptable gases and foamable liquids. More particularly, the invention relates to foam producing devices for use with fluids which tend to clog the pores of conventional foam dispensing devices said devices also permitting the dispensing, if desired, of the fluid as a liquid rather than a foam.

Numerous foam dispensing devices of a non-aerosol type, which are essentially hand held squeeze bottles of relatively small capacity, have been described in, e.g., U.S. Pat. Nos. 3,709,437 and 3,937,364. However, their characteristics cannot be extrapolated to devices of economically desirable large capacity. This is due to the fact that pressure and liquid capacity control is difficult to achieve in view of the small size required in the foam producing means to produce the most desired foams.

U.S. Pat. No. 4,531,660 describes a device intended to overcome the above disadvantages by placing a small inner chamber, associated with the foam producing means, said combination maximizing the foam quality, within a large chamber or reservoir of economically desirable large capacity.

However, said devices suffer from the disadvantage that, after mixing of the gases and liquids, the foams must be passed through porous materials before being dispensed. As a result, in the case of certain fluids, such as Povidone TM, the pores of the foam producing means are ultimately clogged. This is a consequence of the foams having to pass through the pores of the foam producing means.

It is believed, although the theory is not essential to the practice of the invention, that fluids, such as Povidone TM, which are based on polymeric materials, clog the pores of the the porous elements of the foam producing devices by separation and buildup of the polymeric moieties upstream of and/or within the pores of the porous elements.

Furthermore, the described inventions make no provision for dispensing the foamable liquid in a liquid form, if desired, as an alternative to the foam form.

In my U.S. Pat. No. 4,901,925, incorporated herein by reference, there is described a foam dispensing device comprising a foam producing device which obviates the above problem in that the mixing of the components of the foam occurs only after diffusion of the gas through the pores of the porous elements. Thus the foam never passes through any pores and clogging thereof is prevented. Foaming occurs only in the portion of a mixing chamber which is open to the atmosphere and the foam does not have to pass any obstructions before being dispensed to the user.

It has now been found, in accordance with the instant invention that a more simple foam dispensing device may be prepared if dispensing of the foamable liquid, itself, is not required.

It is to be understood throughout the application that references to air and gas may be used interchangably and that the term gas refers to compatible and biologically acceptable gases such as nitrogen.

SUMMARY OF THE INVENTION

An object of the invention is to provide foam dispensing devices for the alternative dispensing of either foams or liquids.

Another object of the invention is to provide means of producing foams in said foam dispensing devices without clogging of the pores of the porous element of the foam producing means.

According to another object of the invention there is provided liquid delivery means which comprises a large outer container, for holding liquid, having a discharge port, an inner container disposed within said outer container and in liquid connection therewith through a port; a closure for said inner container having pressurized air inlet means and foamable liquid outlet means; a tube descending vertically from said closure in liquid communication with the liquid outlet means having an opening at its lower end to provide liquid communication with said inner container; one-way valve means in the inner container to close the port between the inner and outer containers when pressure within the inner container is increased to supply liquid through said liquid outlet means to the foam producing means and to open said port to permit flow of liquid from the outer container to the inner container when pressure in the inner container is decreased.

It is another aspect of the invention to provide foam producing means which are external to both the inner and outer containers.

Another object of the invention is to provide means to alternatively generate foams or dispense unfoamed liquids comprising a porous element comprising a partially gas permeable wall, a gas distribution plenum and a gas entry port in fluid connection with said plenum; a second wall opposite the outer surface of said gas permeable wall; a mixing chamber comprising at one end, the proximal end, a small annular opening between said gas permeable and second wall, comprising an orifice for the uniform distribution of foamable liquid therethrough into said chamber and at the distal end an exit port for the discharge of foams or liquids from said chamber, said chamber being tapered or not, as required; a liquid distribution plenum for the uniform distribution of said foamable liquids to said orifice and a liquid entry port in fluid connection, through a conduit with said plenum wherein said plenum and a source of foamable liquid are in fluid connection through a conduit therebetween; with the proviso that only the portion of said gas permeable wall between said orifice and said exit port is gas permeable said device further comprising, in the conduit between said pressurized gas source and said gas distributing plenum valve means to prevent entrance of said gas to said device when only the dispensing of liquid is desired.

Another aspect of the invention is to provide valve means to prevent entrance of said gas into said porous element when only the dispensing of liquid is desired.

Yet another aspect of the invention is to provide a squeeze bottle type of foam dispensing device comprising a container, or rv, for foamable liquid, comprising a semi-rigid container comprising at one end a discharge port, to supply foamable liquid to the foam producing means which can dispense said foamable liquid in the form of foam or liquid, alternatively. It is yet another aspect of the invention to provide foam producing means less susceptible to clogging, during foam production, than the foam producing means of the prior art.

According to another aspect of the invention there is provided foam producing means which can alternatively dispense either liquid or foam.

Yet another aspect of the invention is to provide valve means to selectively direct pressurized air only to the inner container if liquid dispensing alone is desired or to said container and the foam producing means if it is desired to dispense foam.

Another aspect of the invention is to provide a squeeze bottle type of foam dispensing device comprising a container, or reservoir, for foamable liquid, comprising a semi-rigid container comprising at one end a discharge port, to supply foamable liquid to the foam producing means which can dispense said foamable liquid in the form of foam or liquid, alternatively.

According to this aspect there is provided foam producing means comprising a housing comprising a base comprising air and liquid inlet ports; a porous element comprising a partially porous wall and an air inlet port in fluid connection with the air inlet port of said base; a fluid distribution base, into which the base of the housing may be rotatably inserted, comprising air and liquid outlet ports, and a hollow tube, or conduit, descending vertically therefrom in fluid connection with said air outlet port the opposite end being sealed by a one-way valve which opens upon inversion of the outer container of the foam dispensing device and application of pressure thereto, for passage of air therethrough, and, if desired, into said porous element said valve closing, upon release of pressure to the outer container, with a concomitant decrease of pressure therein, and reinversion thereof, to prevent flow of liquid and/or air into said conduit; the base of said housing being partially rotatable within said distribution base to permit aligning of all of the liquid transmission ports when only dispensing of liquid is desired, aligning of both the liquid and air transmission ports when generation and dispensing of foams is desired and aligning none of said ports when no dispensing is desired.

The foamable liquid reservoir comprises at one end a discharge port into which the foam producing means is inserted and held in place by a cap having internal threads matched to the external threads of the neck of said reservoir or other retaining means known to the art.

Another object of the invention is to provide a device for dispensing foams, where the ability to alternatively dispense liquid is not required, wherein the foam producing device comprises a portion of the conduit descending from the cap of the liquid supply container thereby obviating the need for valve means to control the flow of the pressurized gas to the liquid supply means and the foam producing device.

Other objects will become apparent from the accompanying Figures and detailed description of the invention.

BRIEF DESCRIPTION OF THE DRAWINGS

FIG. 9 is a cross-sectional view taken along line D—D of FIG. 7.

FIG. 10 is a cross-sectional view taken along line E—E of FIG. 8.

FIG. 11 is a cross-sectional view taken along line F—F of FIG. 8.

FIG. 12 is a cross-sectional view taken along line G—G of FIG. 8.

FIG. 13 is a cross-sectional view taken along line H—H of FIG. 8.

DETAILED DESCRIPTION OF THE PREFERRED EMBODIMENT

Figure 1:
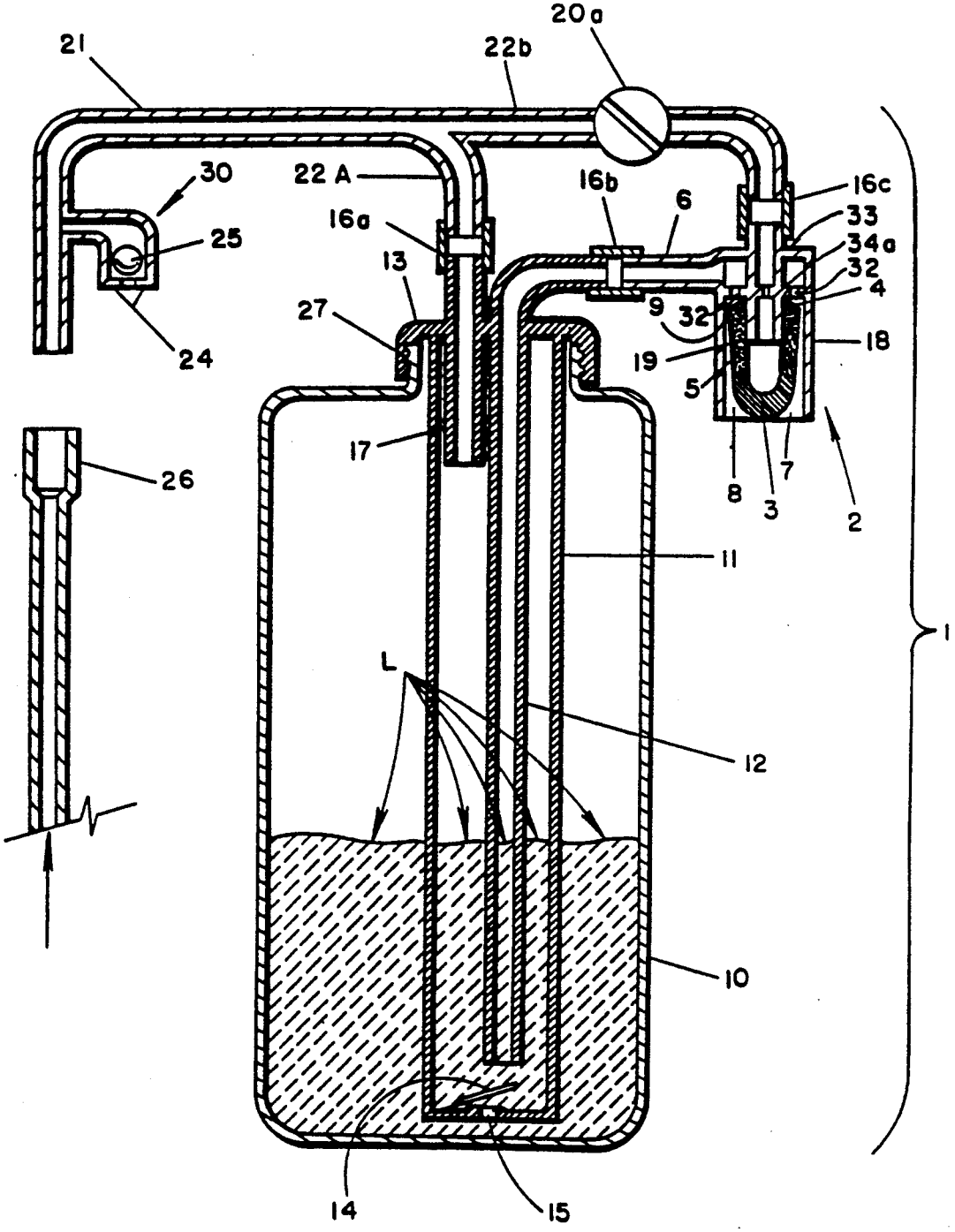
FIG. 1 is an elevational sectional view of the foam dispensing device of the invention.

In accordance with this invention there is provided a foam producing for producing foams, by admixing foamable liquids and gases, for use in a foam dispensing device said foam producing device comprising a hollow mixing chamber comprising a peripheral side wall and a proximal opening through which said foams are discharged; inlet means for passing said foamable liquids from a source therefor into said mixing chamber; and porous means, situated between said opening and liquid inlet means, for passing said gases, from a source therefor, into said mixing chamber.

In a preferred embodiment said foam producing device further comprises flow control means within said mixing chamber to control the flow of the foamable liquids therein.

The invention is best understood in connection with the drawings.

Referring now to FIGS. 1-5 there is described a foam dispensing device which is generally indicated by 1 comprising an outer container 10 having a neck 27 which defines an exit port. The device also includes a cap 13, which may be affixed to the outer portion of said neck means by matched threads on the inner portion of the vertical wall of said cap and the outer wall of said neck or by any other means known to the art.

The outer container 10 provides a large reservoir of foamable liquid, L. and may be formed of any compatible rigid or non-rigid materials such as plastics, metals & glasses.

The cap also provides a tubular element 11 descending vertically therefrom and forming an inner container within said outer container which acts as a smaller auxiliary reservoir for the foamable liquid.

The cap 13 further comprises a gas inlet stem 17 passing therethrough for admission of pressurized air to the inner container and a tube 12 descending vertically from the bottom of said cap said tube having an opening at the bottom thereof for liquid connection to the inner container for transfer of foamable liquid from said inner container to foam producing means upon application of pressurized air to the surface of said liquid L in the inner container 11.

The foam dispensing device further comprises foam producing means in fluid connection with said inner tube 12. Said producing means may be inserted in the neck of container 10 or external thereto.

Figure 2:
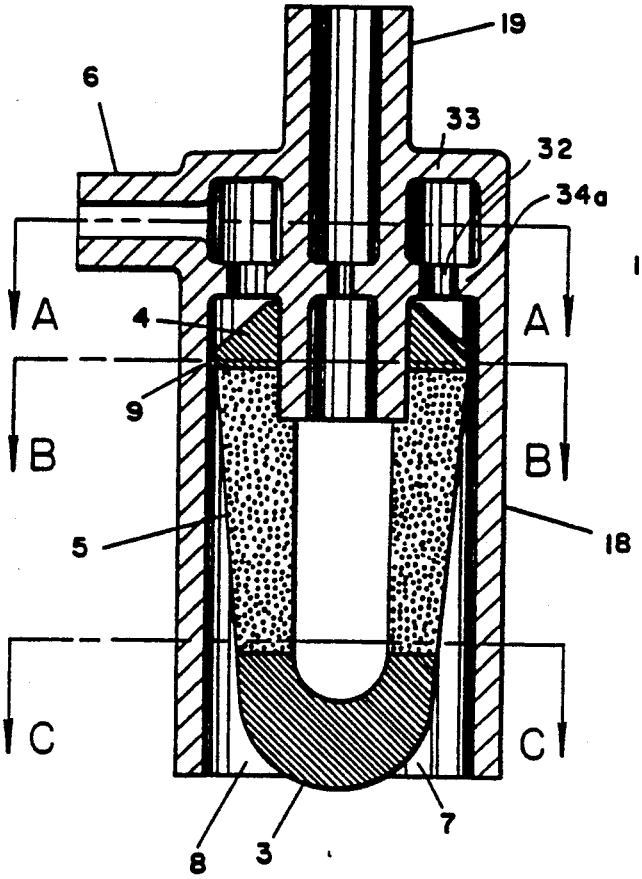
FIG. 2 is an elevational sectional view of a first embodiment of the foam producing means of the invention.
Figure 3:
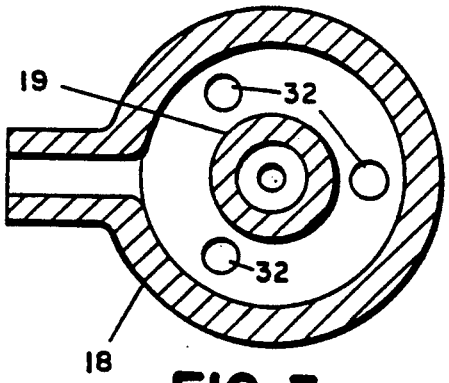
FIG. 3 is a cross-sectional view of the foam producing means along line A—A of FIG. 2.
Figure 4:
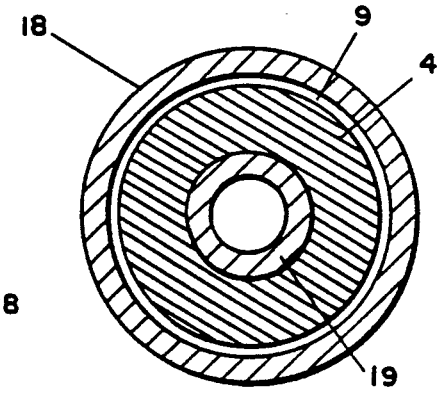
FIG. 4 is a cross-sectional view of the foam producing means along line B—B of FIG. 2.
Figure 5:
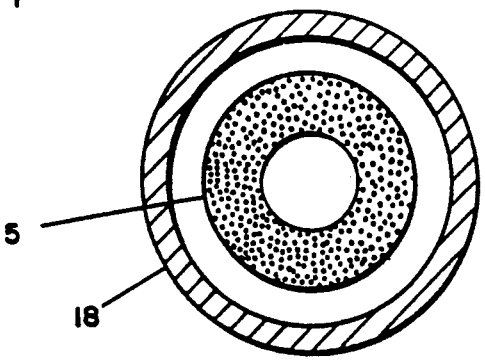
FIG. 5 is a cross-sectional view of the foam producing means along line C—C of FIG. 2.

A preferred first embodiment of the foam producing device of the invention is shown in FIGS. 2, 4 and 5, and generally indicated by the numeral 2 comprises a housing 18 comprising a porous element 7, and gas inlet means comprising a stem 19 passing through the upper wall 33 and inner wall 31 of said housing and into said porous element for the delivery of pressurized air thereto as required.

The wall of said porous element 7 flares outwardly from the inlet port thereto and the end opposite said inlet port to create a narrow annular space, or orifice, 9 between said element and the inner wall of the housing. The portion 4 of the wall of the element between said orifice and the inlet port of the element as well as the portion 3 of the wall of the element extending from the other end towards said orifice are non-porous and air cannot diffuse through those portions of the element 7. The remainder 5 of said wall is porous. The porous portion of the wall may be chosen from materials well known in the art such as 70 um open celled polyethylene. The non-porous portions may be formed in any manner known to the art including painting and curing of an epoxy resin on a preformed porous wall in those areas where non-porosity is desired. Furthermore, if desired, the permeability of the porous portion may be limited to only gases and even to specific gases. The choice of materials and processes of formation will be selected by the user in accordance with his requirements.

Said housing 18 further comprises fluid inlet means 6, positioned between the horizontal walls 31 and 33 of said housing, which is in fluid communication with the liquid outlet means 12 of the inner container 11 through connector 16*b* and with the space between said porous element and said housing wall 18 through liquid entry ports 32 in inner horizontal wall 31 of said housing.

The dispensing device further comprises a dual branched pressurized air delivery tube 21 in fluid connection, at a first branch 22*b*, with inlet stem 19 through valve 20*a* and connector 16*c*. Said gas delivery tube is also in fluid connection, at a second branch 22*a*, with stem 17 through connector 16*a*.

Tube 21 further comprises a one-way valve for return of air to the pressurized air source comprising a port 23 for admission of air to the tube 21, a valve seat 24 and a ball 25 whose diameter is greater than that of the valve seat.

It is, of course, understood that any one-way valve, known to the art may be used here.

Furthermore, as desired, other compatible pressurized gases, such as nitrogen, may be used in lieu of air as well as other means of relieving the pressure in tube 21 or for other applications where air is called for.

Fluid connection between tube 21 and the pressurized air source is provided by means of connector 26.

Said inner container 11 further comprises at its lower end a liquid entry port 15 and a flapper valve 14 which closes said port when the pressure within said inner container exceeds that in the outer container.

Thus, in the embodiment shown, pressurized air is provided from any pressurized air source through tube 21 and inlet 17 to the inner container to force foamable liquid through delivery tube 12 to the foam producing means whence it passes through the small annular orifice 9 over the outer surface of porous portion of element 7.

If foam is the desired product valve 20*a* is opened thereby allowing air to also enter the porous element through branch 22*b* of the gas delivery tube 21 and inlet 19 and pass through the porous portion of the wall thereof to mix with the foamable liquid passing through orifice 9 and over the outer surface of the porous portion 5 of the porous element 7 thereby producing foam for discharge through port 8.

However, in the event only dispensing of liquid is desired valve 20*a* is closed. Then pressurized air is only applied to the foamable liquid in container 11 through branch 22*a* of delivery tube 21 whereby said liquid is transferred to the foam producing means through conduit 12 and liquid inlet 6 and is discharged therefrom through discharge port 8 as a liquid.

Upon release of pressure within the foam dispensing device, i.e., upon cessation of dispensing of either foam or liquid, air is returned to the pressurized air source through valve 30 and the pressure in the foam dispensing device having been decreased valve 14 opens permitting liquid to enter the inner container 11 from the outer container 10 through port 15 until the liquid levels within said containers 10 and 11 and conduit 12 are equalized. Of course, other means, known to the art, may be used to return air to the pressurized air source and equalize the pressure within the system.

In the embodiment shown foamable liquid is initially present in containers 10 and 11 and tube 12 to the same height. When it is desired to dispense foam or liquid, pressurized air from a pressurized air source (not shown) enters the inner container 11 through tube 21, branch 22*a* and gas inlet 17. The pressurized air causes the valve 14 to close thereby preventing any backflow from the inner container 11 to the outer container 10 through port 15. The pressurized air causes foamable liquid to rise through tube 12 and be delivered to the foam producing means 2 through inlet tube 6. The liquid then passes over the porous element 7, through orifice 9, and mixes with air passing through the pores thereof to form foam said foam then being discharged through exit port 8.

The pressurized air required for foam production is delivered into the porous element 7, through the pores of which it passes to mix with the foamable liquid to form the foam, through branch 22*b* of delivery tube 21 and inlet tube 19 which are brought into fluid connection through valve 20*a* which is open.

During delivery of pressurized air to the foam dispensing device one-way valve 30 is closed due to the pressurized air forcing ball 25 against seat 24. After dispensing of the foam, the pressurized air delivery is terminated whence the pressure in the system drops. Valve 30 opens to allow atmospheric air to enter the system and valve 14 opens to allow foamable liquid to enter container 11 and tube 12 from container 10.

When it is desired to dispense liquid the above steps and effects are repeated except that valve 20*a* is maintained in a closed condition thereby preventing entrance of air into the porous element 7 and therethrough to mix with the foamable liquid. Thence, the liquid delivered to the foam producing means through inlet tube 6 passes over the porous element 7 and, lacking air to mix with to form foam, is discharged through port 8 as a liquid.

Figure 6A:
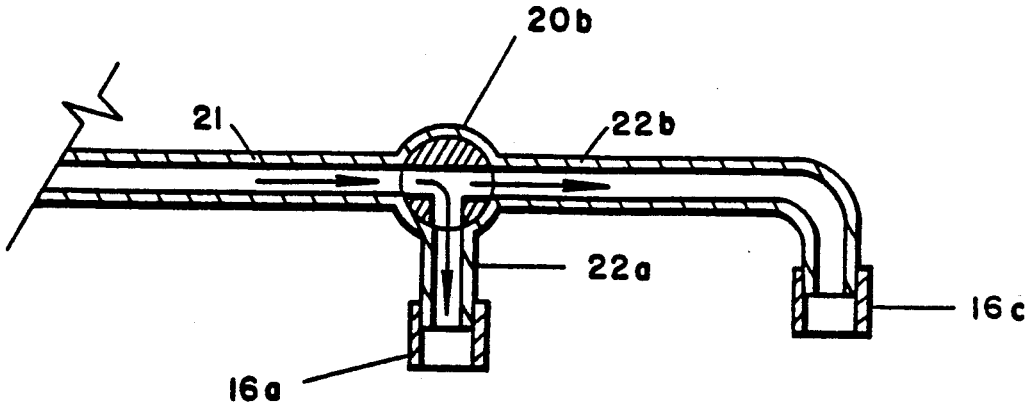
FIG. 6 is an elevational sectional view of an alternate gas valving system for the foam dispensing device of FIG. 1.
Figure 6B:
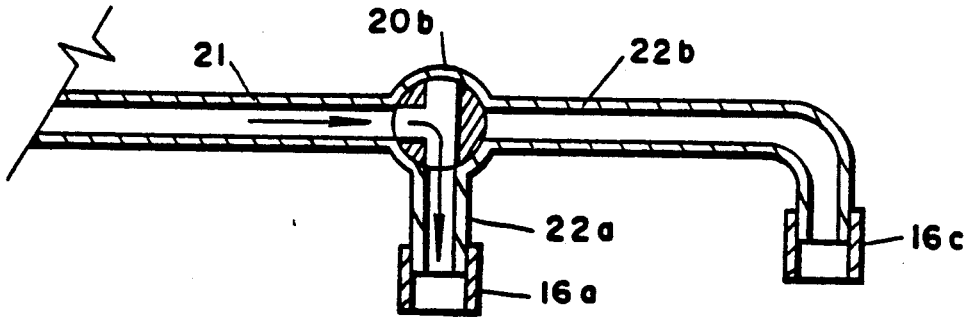
Figure 7:
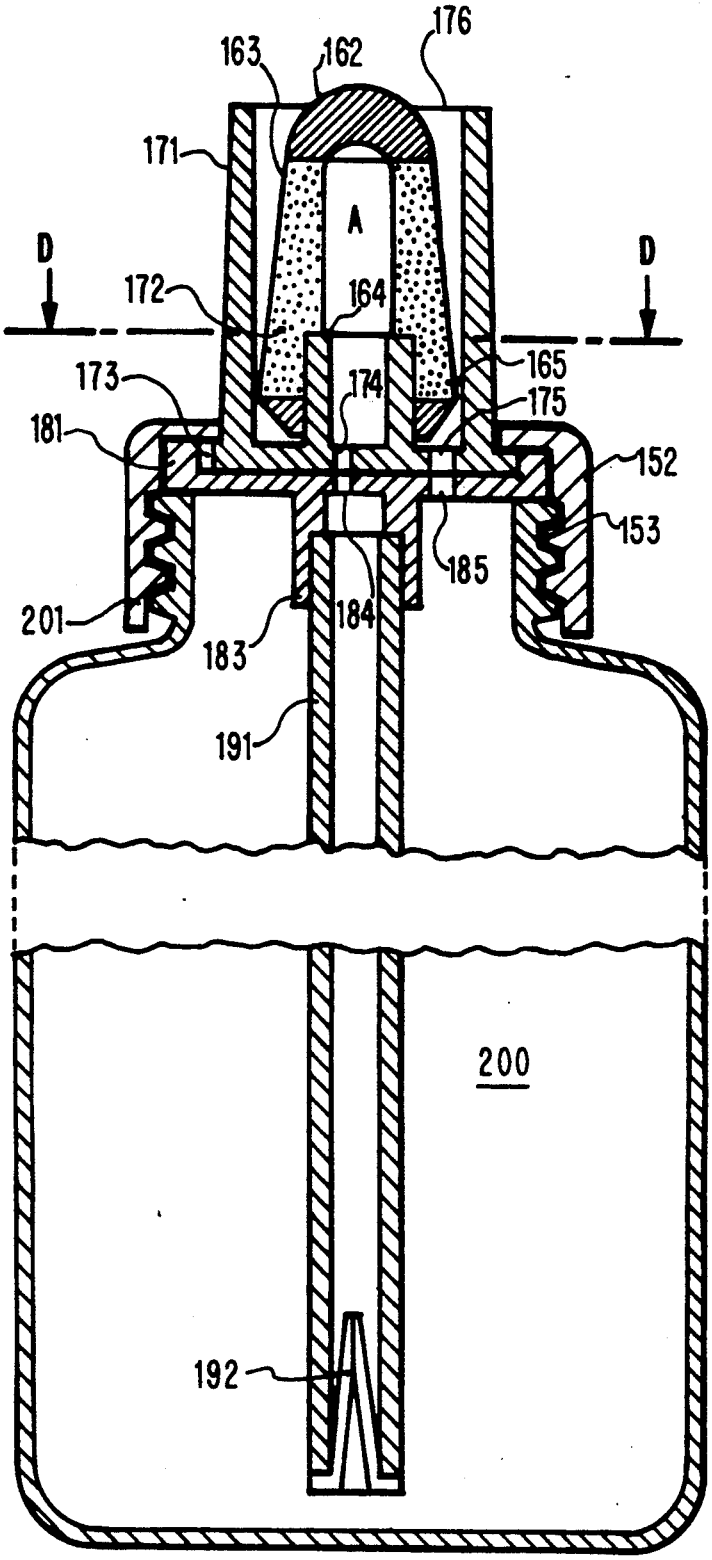
FIG. 7 is an elevational sectional view of a second embodiment of this invention.

In modification of the above embodiment of the foam dispensing device the two-way valve 20*a* for controlling gas flow to the inner container 11 and, if desired to the foam producing means is replaced by a three-way valve 20*b*, as shown in FIG. 6, situated at the branching point of tube 21 and branches 22*a* and 22*b*. In this embodiment the valve 20*b* is opened only to branch 22*a* (FIG. 6(*b*)) if dispensing of liquid is desired or to both branches 22*a* and 22*b* (as shown in FIG. 6(*a*)) if it is desired to dispense foam.

A second embodiment of the foam dispensing device of this invention, illustrated in FIGS. 7–13 consists of a hand held device 140 for the dispensing of foamable liquids, alternatively, as either liquids or foams, said device comprising a foam producing means and a liquid reservoir to supply foamable liquid to said foam producing means.

Said foam producing means comprises a housing 170 comprising a base 177 from which a wall 171 and a ring 172 spaced inwardly from said wall rise vertically. Said base further comprises a gas transmission port 174, spaced inwardly from said ring 172 and off center, and at least one liquid transmission port 175 between said wall 171 and said ring 172. Said base further comprises a partial horizontal ring 173 extending outwardly therefrom.

The foam producing means further comprises a porous element 160, encompassed by and spaced from said wall 171, through which foam generating gases may diffuse, if the production of foam is desired, to mix with foamable liquid passing over the outside of the porous element.

The porous element comprises a wall comprising a non-porous tip 162 and an opening 166 for entry of foam producing gas therethrough into the porous element. The wall of the porous element flares outwardly from said base and said tip toward the wall 171 of the housing therebetween to form a small orifice 165 for passage of foamable liquid therethrough and an annular horizontal indentation 164 to seat upon the inner ring 172 of the housing.

Figure 8:
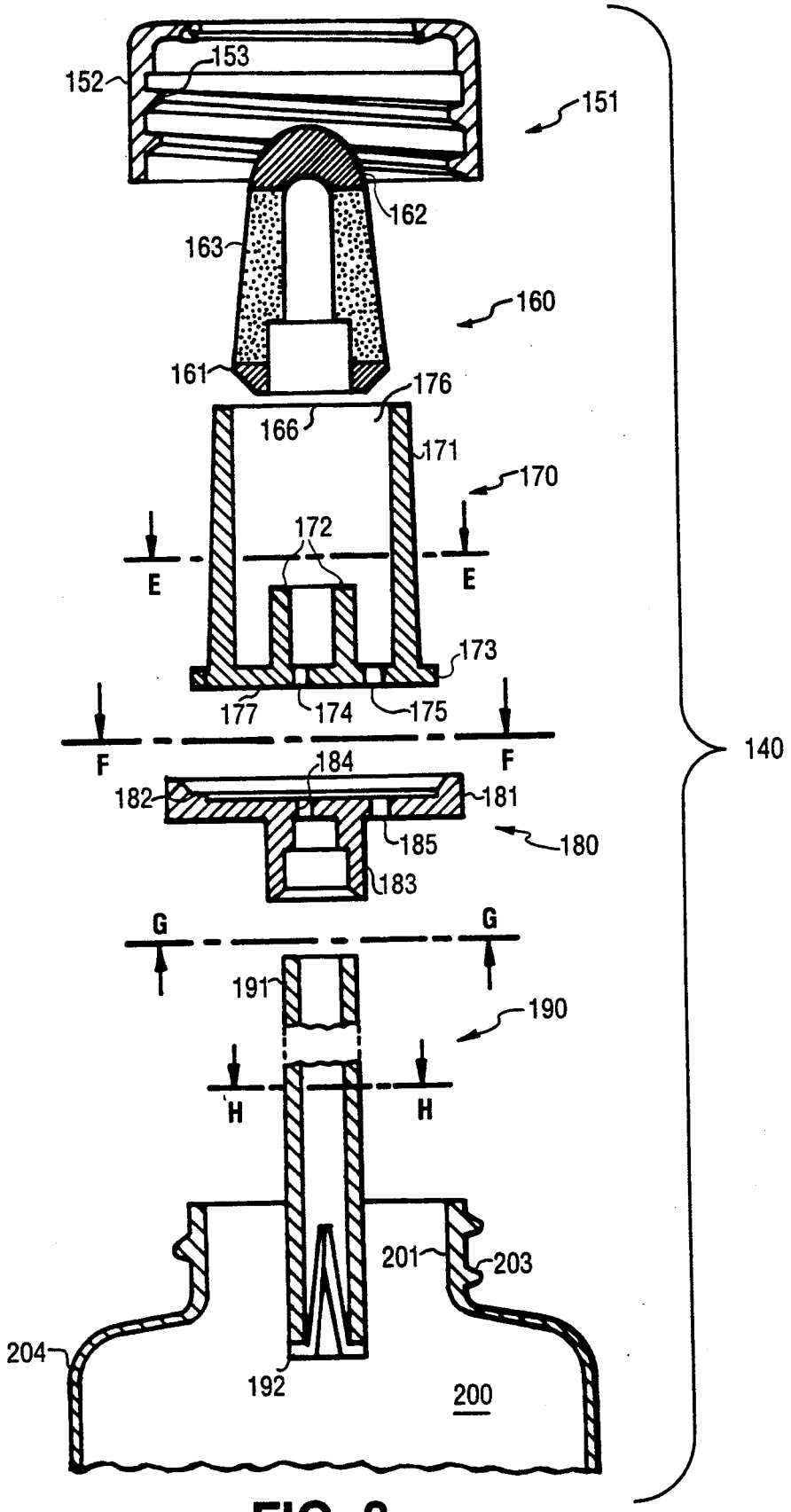
FIG. 8 is an exploded elevational view of the invention of FIG. 7.
Figure 14:
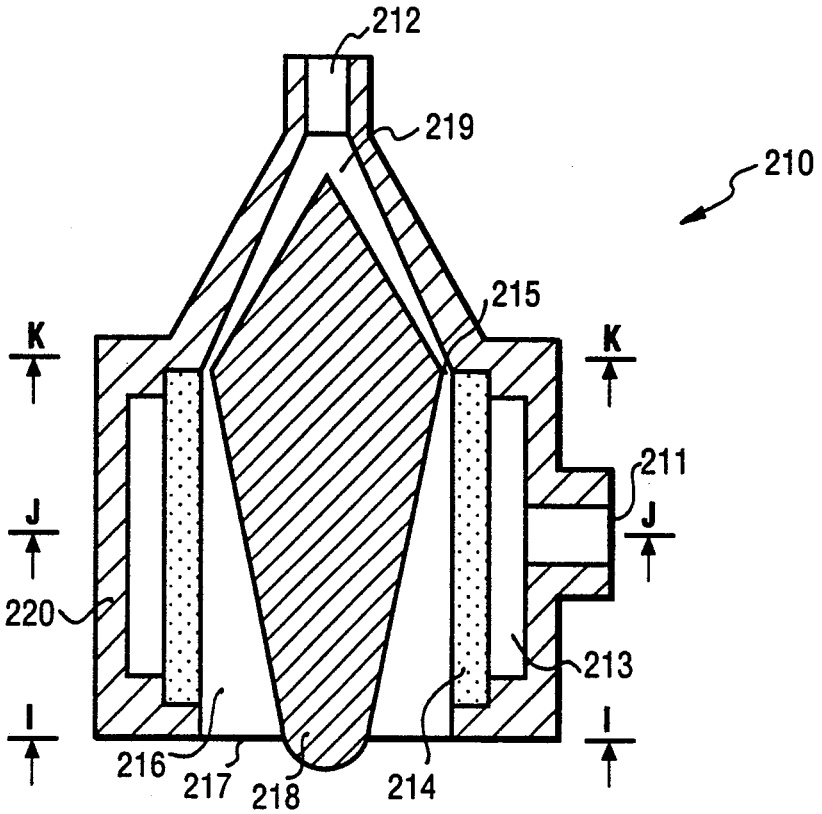
FIG. 14 is an elevational cross-sectional view of a second embodiment of the foam producing device of the invention.
Figure 15:
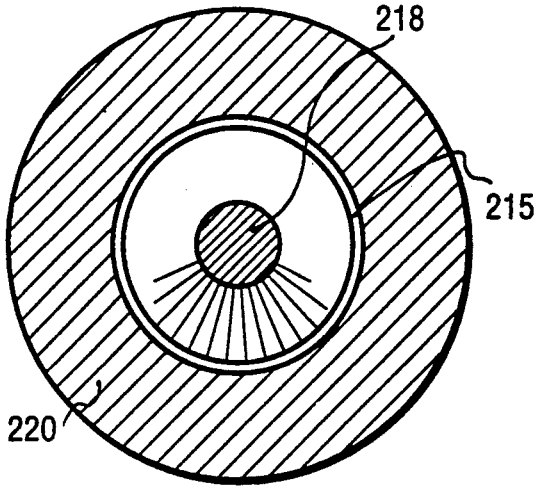
FIG. 15 is a sectional view along line I—I of FIG. 14 in the direction indicated.
Figure 16:
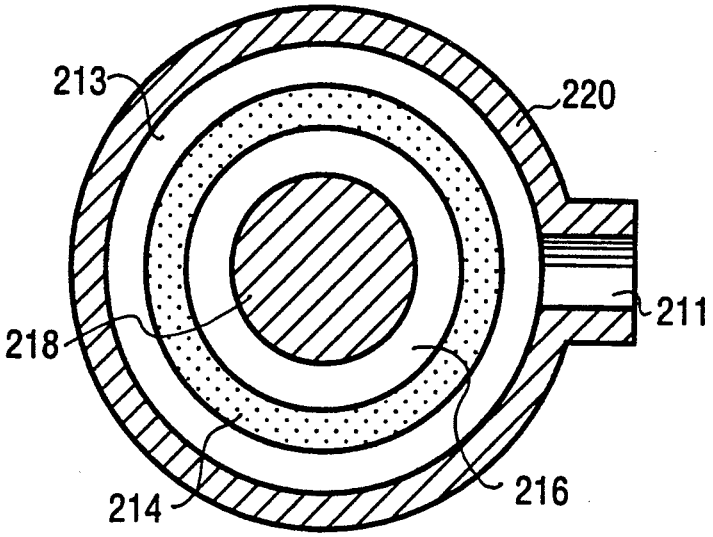
FIG. 16 is a sectional view along line J—J of FIG. 14 in the direction indicated.
Figure 17:
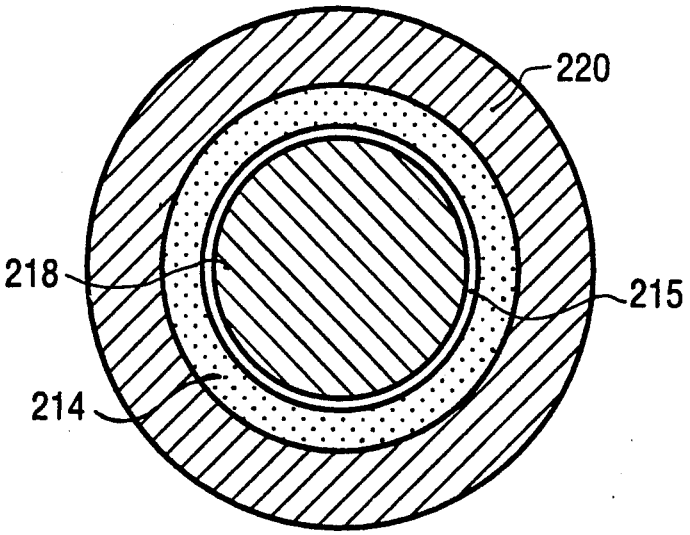
FIG. 17 is a sectional view along line K—K of FIG. 14 in the direction indicated.
Figure 18:
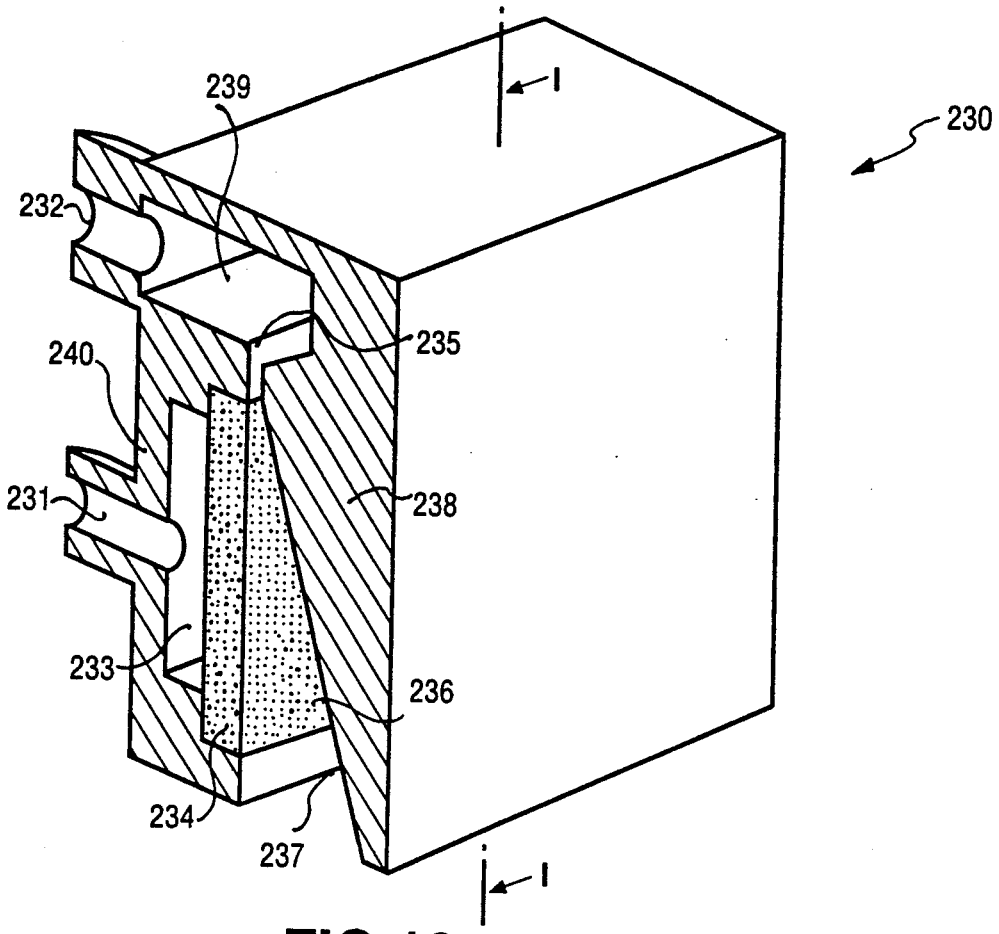
FIG. 18 is an elevational perspective view of a third embodiment of the foam producing device of the invention cut away to show details.
Figure 19:
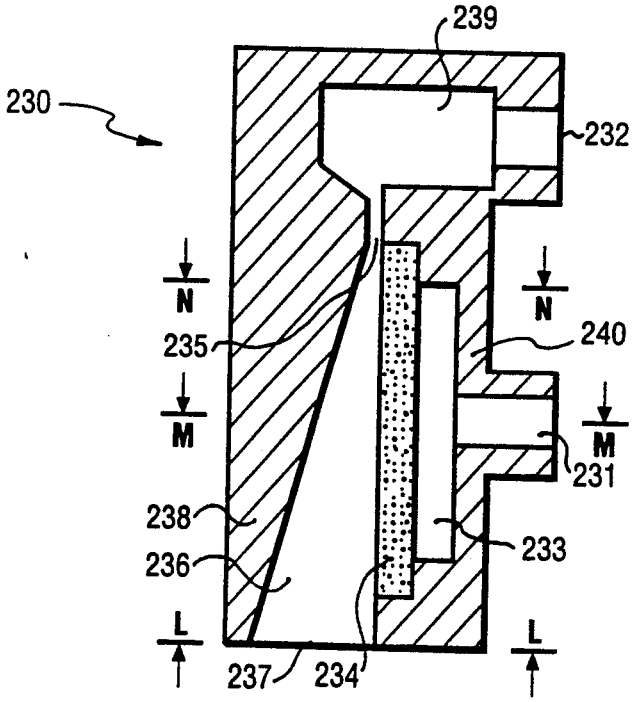
FIG. 19 is a side elevational cross-sectional view taken along line 1—1 of FIG. 18 in the direction indicated.
Figure 20:
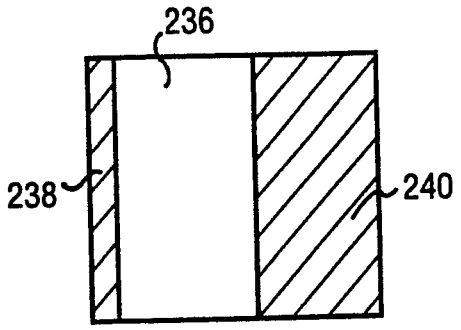
FIG. 20 is a sectional view along line L—L of FIG. 19 in the direction indicated.
Figure 21:
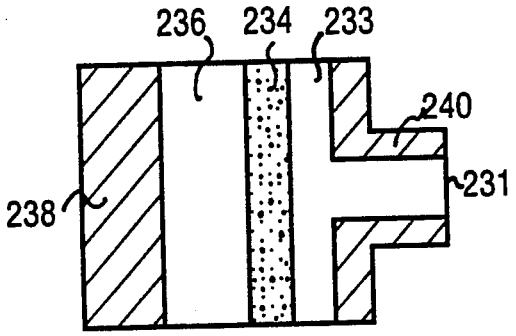
FIG. 21 is a sectional view along line M—M of FIG. 19 in the direction indicated.
Figure 22:
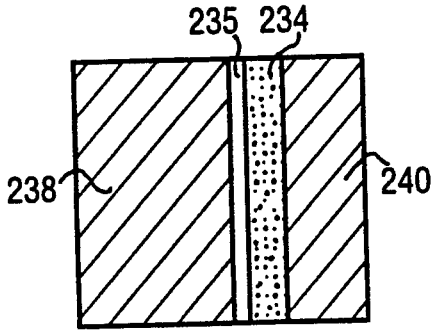
FIG. 22 is a sectional view along line N—N of FIG. 19 in the direction indicated.

As shown in FIG. 8 the foam producing means further comprises a fluid control base 180 comprising an outer wall 181 rising vertically therefrom, a vertical wall 183 descending vertically therefrom, at least one liquid transmission port 185 situated between wall 181 and 183, a gas transmission port 184 spaced inwardly from said ring 183 as well as a tab 182 protruding horizontally outward from said wall 181 to engage, as desired, one or another of the ends of ring 173 of the base 177.

The housing 170 may be rotated within the control base 180 whereby the tab 182 may engage one or another end of ring 173 to allow alignment of the liquid transmission ports 175 and 185 and, if desired, gas transmission ports 174 and 184.

The control base 180 also comprises a gas transmission conduit 190 comprising a hollow tube 191, inserted in and descending from ring 183, in fluid connection with the gas transmission port 184 said tube being closed at its other end by a one-way valve 192.

The foam producing means also comprises a non-rigid container 200 for supplying liquid and, if desired, air to the foam producing means. The container 200 comprises a discharge port 202, at its upper end which comprises a wall 201 comprising at its upper end a neck the vertical wall of which comprises on its outside threads 203 to engage the threads 153 of the cap 151.

In the practice of foam, or liquid dispensing, using this embodiment of the invention the container is partially filled with foamable liquid. The container is then inverted whereby the end of the gas delivery conduit 190 is situated above level of said liquid. The wall 204 of the container is squeezed thereby applying pressure to the liquid and the one-way valve 192 which opens to allow entry of gas therein.

If the dispensing of liquid is desired the housing 170 is rotated, within the base 180, to engage one end of ring 173 and tab 182 whereby the liquid transmission ports 175 and 185 of the housing 170 and control base 180, respectively, are aligned. Then upon squeezing the container foamable liquid is forced therefrom through the liquid transmission ports 185 and 175 and through orifice 165 to exit through port 176. In this position the gas transmission ports 174 and 184 are not aligned and no gas can pass through the porous element to mix with the foamable liquid, streaming over the outer wall of the porous element, to generate foam.

However, if foam production is desired the housing 170 is rotated, within control base 180 to cause the other end of ring 173 and tab 182 to engage whereby all of the gas transmission ports and liquid transmission ports are aligned. Then liquid passes through the liquid transmission ports to pass over the outer wall of the porous element and air passes through the wall of said porous element to mix therewith and form foam which is dispensed through port 176.

The air is supplied to gas transmission port 184 through conduit 190 when value 192 opens upon increasing the pressure within the container by squeezing it. Upon release of pressure on the container valve 192 closes so that no liquid may enter tube 191 when the container is upright. Then air is permitted to reenter the container thus equalizing the pressure therein and providing for a new supply of air when next dispensing of liquid or foam is desired.

Yet a third embodiment of the foam producing means of the invention, designated by numeral 210 and illustrated in FIGS. 14–17, comprises a housing 220, the upper wall comprises a liquid entry port 212 and the lower wall a foam or liquid exit port 217 and the side wall at least one gas entry port 211. A portion of the inner side of said side wall further comprises a porous element comprising a gas permeable wall and a gas distribution plenum 213 gas distribution plenum being in fluid connection with pressurized gas supply such as are described with respect to the first embodiment, through the gas entry port 211. The housing encompasses a wall 218 opposite said gas permeable wall and spaced therefrom by a mixing chamber 216. At the smallest distance between said gas permeable wall 214 and said opposite wall 218 there is formed an annular orifice 215 for passage of foamable liquid from a liquid distribution plenum 219 therethrough and into mixing chamber 216.

Said liquid distribution plenum is in fluid connection with a foamable liquid source, such as is described above with respect to the first embodiment, through the liquid entry port 212.

In the use of this embodiment of the invention foamable liquid is caused to enter the foam producing device 210 through the liquid entry port 212, as described above, and passes through said liquid distribution plenum 219 and orifice 215 into the mixing chamber 216. If dispensing of foam is desired gas is permitted, as above described with respect to the first embodiment, to enter the gas distribution plenum 213, through gas entry port 211, and therefrom into gas permeable wall 214 from which it permeates to mix with said foamable liquid to form the foam which is discharged through foam or liquid exit port 217.

In the event that only discharge of liquid is desired the above steps are effected except that the entrance gas into the porous element is prevented by closure of the valve between the gas supply means and the gas entry port 211.

Yet a fourth embodiment of the invention, generally designated by numeral 230, is illustrated in FIGS. 18–22 wherein the foam producing device comprises planar housing 230 comprising a porous element comprising a gas permeable wall 234, a gas distribution plenum 233 in fluid connection therewith a gas entry port 231 between, and in fluid connection with, said gas distribution plenum 233 and a pressurized gas source. Said housing further comprises in a portion of its inner wall a wall 238 opposite to said gas permeable wall 234 the space therebetween forming a mixing chamber 236. If desired, said opposite wall 238 may be tapered.

Said housing further comprises a liquid distribution plenum 239 in fluid connection with said mixing chamber 236 and a foamable liquid supply source through liquid entry port 232. The liquid distribution plenum 239 is in fluid connection with said mixing chamber 236 through a lengthwise orifice 235 at the smallest distance between said opposite wall 238 and the gas permeable wall 234.

The use of this embodiment of the invention is essentially as described above. Foamable liquid * is caused to enter the mixing chamber 236 of the device through liquid entry port 232, liquid distribution plenum 239 and orifice 235 whence it passes over opposite wall 238 and/or gas permeable wall 234.

If dispensing of foam is desired pressurized gas enters the mixing chamber 236 through gas entry port 231 where it mixes with the foamable liquid to form foam which is discharged through discharge port 237.

In the event only dispensing of liquid is desired the above steps are effected except for the steps transmitting gas to the gas mixing chamber 236.

Figure 23:
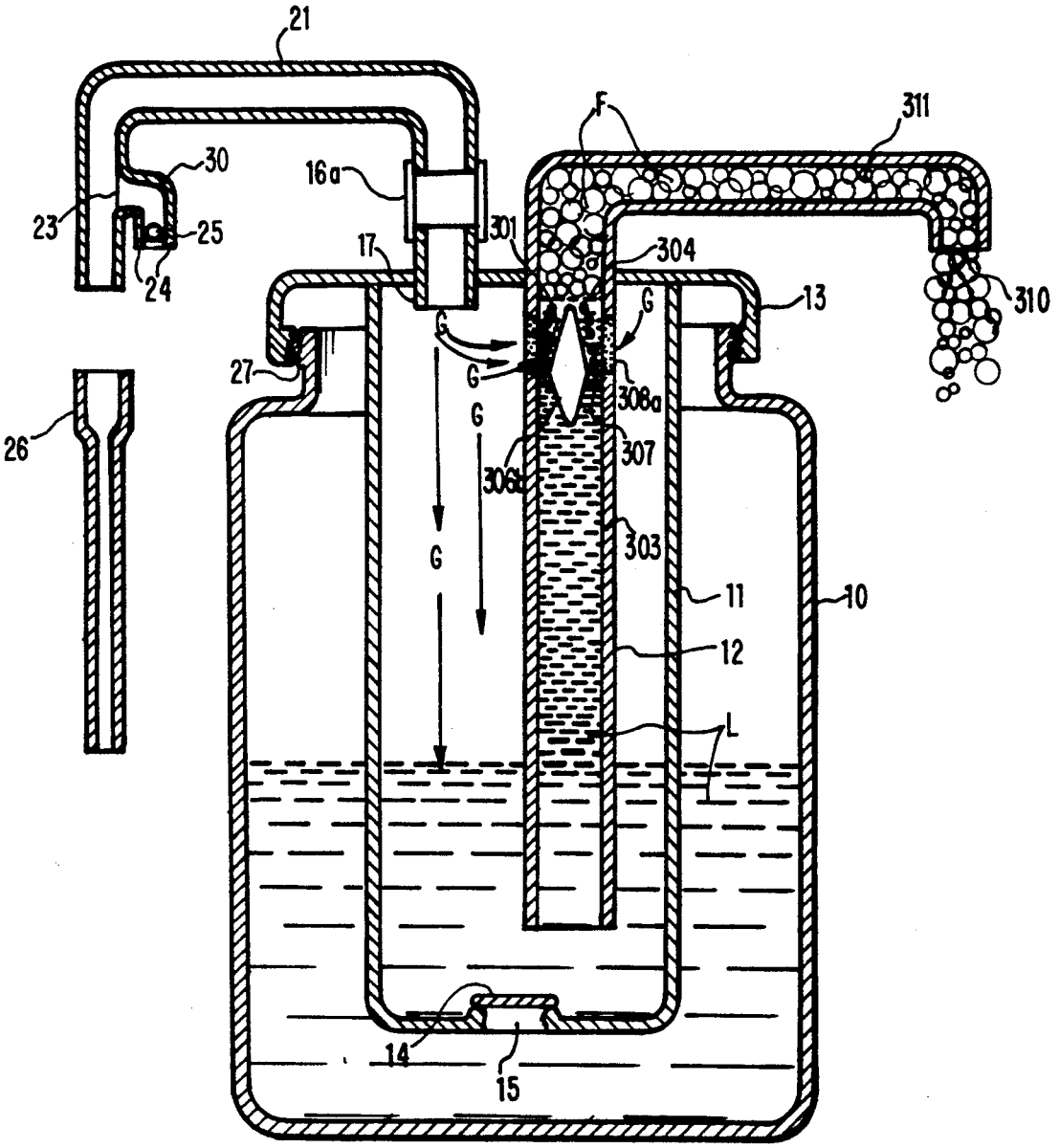
FIG. 23 is an elevational sectional view of a second embodiment of the foam dispensing device of FIG. 1.

A modification of the first embodiment of the invention is illustrated in FIG. 23 wherein a modification of the foam producing device of the first embodiment comprising a portion of the conduit 12 and is situated within the liquid supply container 10. The foam producing device is best considered with respect to FIGS. 31, 32 and 37.

Figure 37:
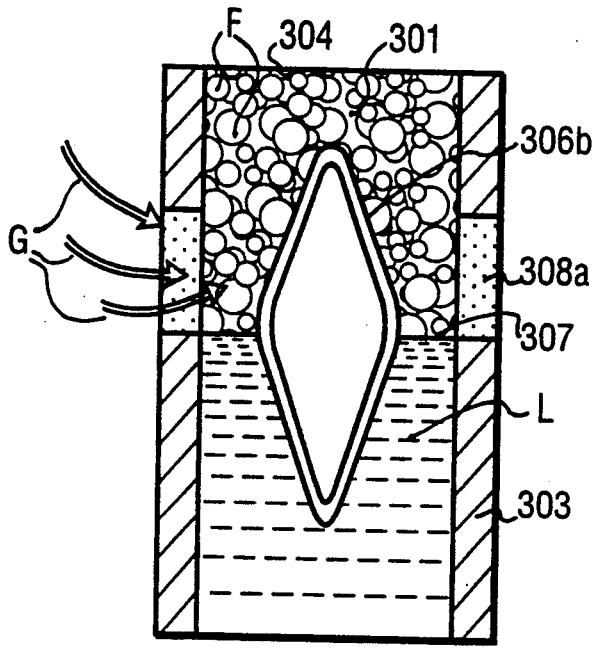
FIG. 37 is an elevational sectional view of the third modification of the embodiment of FIG. 36 during use.

In FIG. 37 there is illustrated a modification of the foam producing device comprising a mixing chamber 301, a peripheral wall 303 encompassing said mixing chamber 301, a flow control device **306*b* within said mixing chamber 301 and annularly spaced from said peripheral wall 303. The annular space 307 comprises a liquid entry port for passage of foamable liquid from the container 10 into the mixing chamber 301. The opposite end of the foam producing device comprises a large opening comprising foam discharge port 304**.

The peripheral wall 303 extends downwardly from said liquid inlet port 307 into the inner container 11, described with respect to FIG. 1, as a fluid connection between the foam producing device and the foamable liquid source, i.e. container 10, and extends upwardly to form a foam dispensing arm 311 terminating in a foam discharge port 310.

In this modification of the foam dispensing device the inner container 11 is connected to the pressurized gas source, described with respect to FIG. 1, through inlet stem 17.

The pressurized gas G enters inner container 11 through inlet stem 17. A portion thereof presses on the surface of the foamable liquid L in the inner container 11. The valve 14 closes thereby preventing the entrance of additional foamable liquid from container 10 into inner container 11. The pressure of the gas G also causes the foamable liquid to rise in conduit 12 until it enters mixing chamber 301 through liquid inlet port 307.

At the same time a portion of the gas passes through the gas permeable wall portion **308*a* of peripheral wall 303 and enters mixing chamber 301 wherein it mixes with the foamable liquid therein to form foam F which passes through foam discharge port 304 and foam dispensing arm 311 to foam discharge port 310** from which it is received by the user.

The pressurized gas supply and delivery means operate as described above with respect to the embodiment of FIG. 1.

Other embodiments and modifications of the foam producing devices of the invention are illustrated in FIGS. 24–35.

Figure 24:
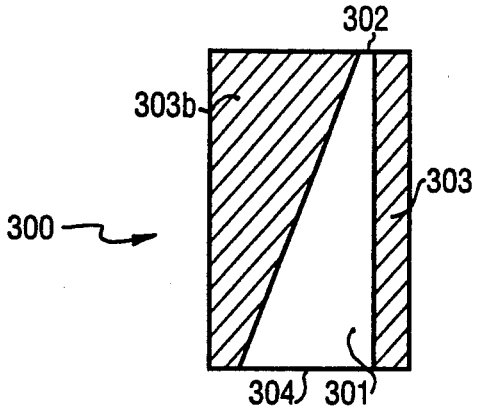
FIG. 24 is an elevational sectional view of a fourth embodiment of the foam producing device of the invention.
Figure 25:
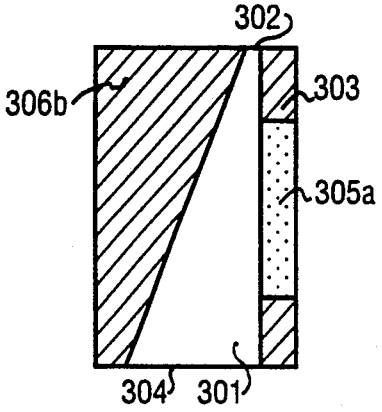
FIG. 25 is a sectional view of a first modification of the embodiment of FIG. 24.
Figure 26:
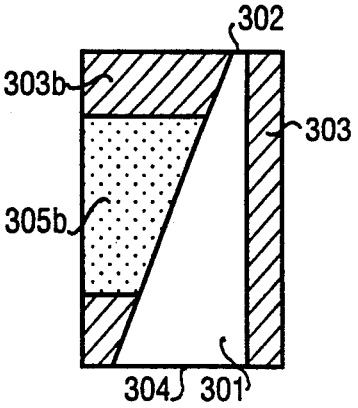
FIG. 26 is a sectional view of a second modification of the embodiment of FIG. 24.

In the embodiment of FIGS. 24–6 the foam producing device does not comprise a flow control device. The foam dispensing device comprises a portion 303*b* of the peripheral wall 303 which is tapered. The liquid inlet port 302 comprises the space between the wall portions 303 and 303*b* where their separation is the least. The porous portion of peripheral wall 303 may comprise a portion 305*b* of the tapered wall portion 303*b* or a portion of the non-tapered wall portion 303. If the porous wall portion extends from the inner to the outer surface of peripheral wall 303 the foam producing device would be used in conjunction with the foam dispensing device of FIG. 23.

If, however, the porous wall portion is connected to the gas supply through a distribution plenum the foam producing device would be used in conjunction with the foam dispensing device of FIG. 1.

Figure 27:
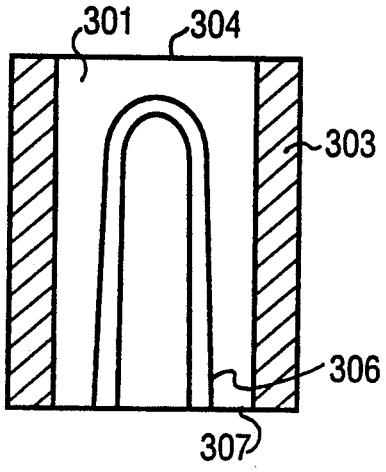
FIG. 27 is an elevational sectional view of a fifth embodiment of the foam producing device of the invention.
Figure 28:
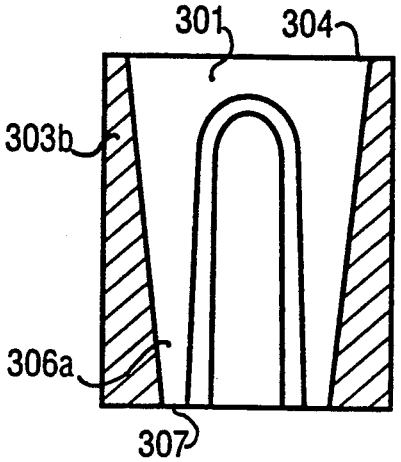
FIG. 28 is a sectional view of a sixth embodiment of the foam producing device of the invention.

In the embodiment of the foam producing device illustrated in FIGS. 27 and 28 the foam producing device comprises a fluid connection comprising a bullet shaped article such as 306 or 306*a* in FIGS. 27 and 28, respectively. The fluid connection divides the liquid flowing into the mixing chamber 301, near the liquid inlet port, and forces it into close proximity with the incoming gases to facilitate complete interaction therewith.

In modifications of the embodiment of FIG. 28 the wall of the mixing chamber 301 comprises a peripheral wall 303*b*. The porous element of the foam producing device may comprise a portion of the wall 303*b* or the wall of the fluid connection 306.

If the porous element comprises a portion 308*a* of the outer wall 303 the foam producing device may be used in conjunction with the embodiment of either FIG. 1 or 23. Thus, if the porous wall portion extends from the inner to the outer surface of peripheral wall 303 the foam producing device would be used in conjunction with the foam dispensing device of FIG. 23 whereas if the porous wall portion is connected to the pressurized gas source through a gas distribution plenum the foam producing device would be used in conjunction with a foam dispensing device such as in FIG. 1.

Figure 29:
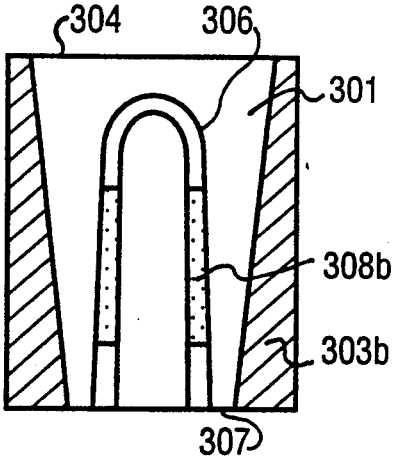
FIG. 29 is a sectional view of a first modification of the embodiment of FIG. 28.
Figure 30:
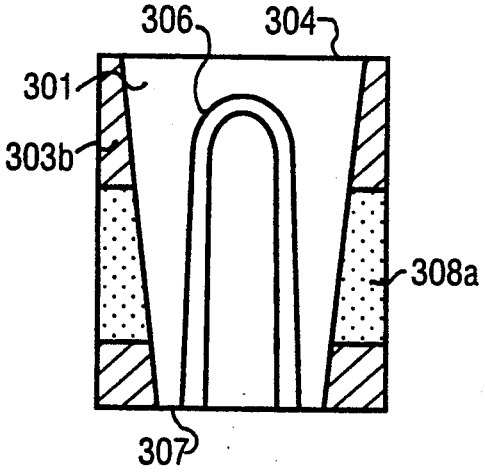
FIG. 30 is a sectional view of a second modification of the embodiment of FIG. 28.

If the foam producing device has the configuration of FIG. 29 it would normally be used in conjunction with the foam dispensing device of FIG. 1 and the fluid control device 306*a* would be hollow and in fluid connection with the pressurized gas source.

Figure 31:
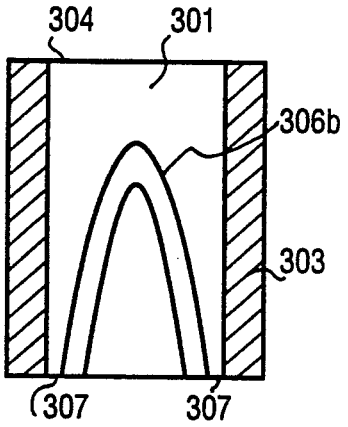
FIG. 31 is a sectional view of seventh embodiment of the foam producing device of the invention.
Figure 32:
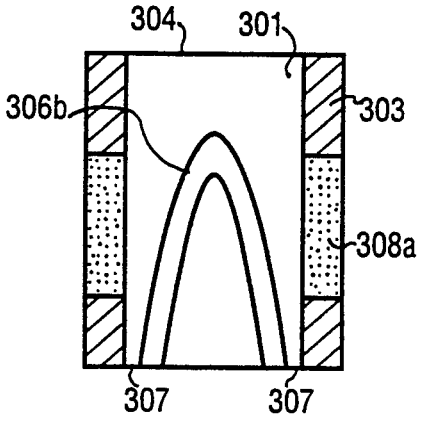
FIG. 32 is a sectional view of a first modification of the embodiment of FIG. 31.
Figure 33:
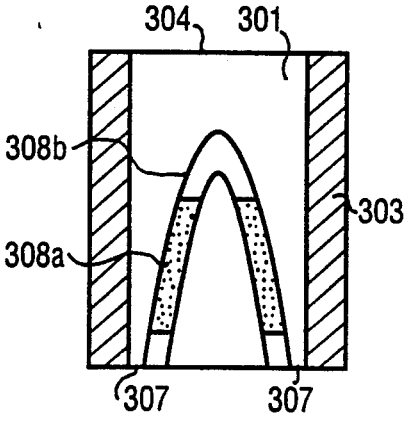
FIG. 33 is a sectional view of a second modification of the embodiment of FIG. 31.

Another embodiment of the foam producing device of the invention, as illustrated in FIGS. 31–33 comprises a fluid connection 306*b* which tapers, within the mixing chamber 301 away from the peripheral wall 303 in the direction from liquid inlet port 307 towards the foam discharge port 304.

If the porous element comprises a portion 308*a* of the outer wall 303 the foam producing device may be used in conjunction with the embodiment of either FIG. 1 or 23. Thus, if the porous wall portion extends from the inner to the outer surface of peripheral wall 303 the foam producing device would be used in conjunction with the foam dispensing device of FIG. 23 whereas if the porous wall portion is connected to the pressurized gas source through a gas distribution plenum the foam producing device would be used in conjunction with a foam dispensing device such as in FIG. 1.

If the foam producing device has the configuration of FIG. 33 it would normally be used in conjunction with the foam dispensing device of FIG. 1 and the 308*a* would be hollow and in fluid connection with the pressurized gas source.

Figure 36:
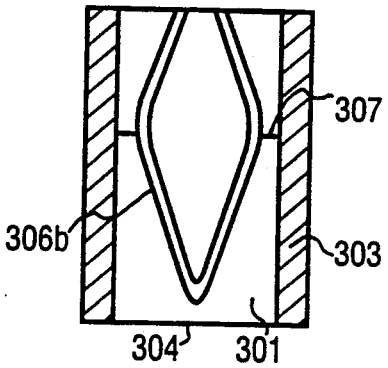
FIG. 36 is a sectional view of a third modification of the embodiment of FIG. 31.

FIG. 37 illustrates a portion of the foam producing device of FIG. 36, as used in conjunction with foam dispensing device of FIG. 23 wherein the foam producing device thereof corresponds to the foam producing device of FIG. 32 and wherein the porous wall portion extends through the portion of peripheral wall 303 within the mixing chamber 301.

A modification of the first embodiment of the invention is illustrated in FIG. 23 wherein a modification of the foam producing device of the first embodiment comprising a portion of the conduit 12 and is situated within the liquid supply container 10. The foam producing device is best considered with respect to FIGS. 31, 32 and 37.

In FIG. 37 there is illustrated a modification of the foam producing device comprising a mixing chamber 301, a peripheral wall 303 encompassing said mixing chamber 301, a flow control device 306*b* within said mixing chamber 301 and annularly spaced from said peripheral wall 303. The annular space 307 comprises a liquid entry port for passage of foamable liquid from the container 10 into the mixing chamber 301. The opposite end of the foam producing device comprises a large opening comprising foam discharge port 304.

The peripheral wall 303 extends downwardly from said liquid inlet port 307 into the inner container 11, described with respect to FIG. 1, as a fluid connection between the foam producing device and the foamable liquid source, i.e. container 10, and extends upwardly to form a foam dispensing arm 311 terminating in a foam discharge port 310.

In this modification of the foam dispensing device the inner container 11 is connected to the pressurized gas source, described with respect to FIG. 1, through inlet stem 17.

The pressurized gas G enters inner container 11 through inlet stem 17. A portion thereof presses on the surface of the foamable liquid L in the inner container 11. The valve 14 closes thereby preventing the entrance of additional foamable liquid from container 10 into inner container 11. The pressure of the gas G also causes the foamable liquid to rise in conduit 12 until it enters mixing chamber 301 through liquid inlet port 307.

At the same time a portion of the gas passes through the gas permeable wall portion 308*a* of peripheral wall 303 and enters mixing chamber 301 wherein it mixes with the foamable liquid therein to form foam F which passes through foam discharge port 304 and foam dispensing arm 311 to foam discharge port 310 from which it is received by the user.

The pressurized gas supply and delivery means operate as described above with respect to the embodiment of FIG. 1.

Other embodiments and modifications of the foam producing devices of the invention are illustrated in FIGS. 24–35.

In the embodiment of FIGS. 24–6 the foam producing device does not comprise a flow control device. The foam dispensing device comprises a portion 303*b* of the peripheral wall 303 which is tapered. The liquid inlet port 302 comprises the space between the wall portions 303 and 303*b* where their separation is the least. The porous portion of peripheral wall 303 may comprise a portion 305*b* of the tapered wall portion 303*b* or a portion of the non-tapered wall portion 303. If the porous wall portion extends from the inner to the outer surface of peripheral wall 303 the foam producing device would be used in conjunction with the foam dispensing device of FIG. 23.

If, however, the porous wall portion is connected to the gas supply through a distribution plenum the foam producing device would be used in conjunction with the foam dispensing device of FIG. 1.

In the embodiment of the foam producing device illustrated in FIGS. 27 and 28 the foam producing device comprises a fluid connection comprising a bullet shaped article such as 306 or 306*a* in FIGS. 27 and 28, respectively. The fluid connection divides the liquid flowing into the mixing chamber 301, near the liquid inlet port, and forces it into close proximity with the incoming gases to facilitate complete interaction therewith.

In modifications of the embodiment of FIG. 28 the wall of the mixing chamber 301 comprises a peripheral wall 303*b*. The porous element of the foam producing device may comprise a portion of the wall 303*b* or the wall of the fluid connection 306.

If the porous element comprises a portion 308*a* of the outer wall 303 the foam producing device may be used in conjunction with the embodiment of either FIG. 1 or 23. Thus, if the porous wall portion extends from the inner to the outer surface of peripheral wall 303 the foam producing device would be used in conjunction with the foam dispensing device of FIG. 23 whereas if the porous wall portion is connected to the pressurized gas source through a gas distribution plenum the foam producing device would be used in conjunction with a foam dispensing device such as in FIG. 1.

If the foam producing device has the configuration of FIG. 29 it would normally be used in conjunction with the foam dispensing device of FIG. 1 and the fluid control device 306*a* would be hollow and in fluid connection with the pressurized gas source.

Another embodiment of the foam producing device of the invention, as illustrated in FIGS. 31–33 comprises a fluid connection 306*b* which tapers, within the mixing chamber 301 away from the peripheral wall 303 in the direction from liquid inlet port 307 towards the foam discharge port 304.

If the porous element comprises a portion 308*a* of the outer wall 303 the foam producing device may be used in conjunction with the embodiment of either FIG. 1 or 23. Thus, if the porous wall portion extends from the inner to the outer surface of peripheral wall 303 the foam producing device would be used in conjunction with the foam dispensing device of FIG. 23 whereas if the porous wall portion is connected to the pressurized gas source through a gas distribution plenum the foam producing device would be used in conjunction with a foam dispensing device such as in FIG. 1.

If the foam producing device has the configuration of FIG. 33 it would normally be used in conjunction with the foam dispensing device of FIG. 1 and the flow control device 308*a* would be hollow and in fluid connection with the pressurized gas source.

FIG. 37 illustrates a portion of the foam producing device of FIG. 36, as used in conjunction with foam dispensing device of FIG. 23 wherein the foam producing device thereof corresponds to the foam producing device of FIG. 32 and wherein the porous wall portion extends through the portion of peripheral wall 303 within the mixing chamber 301.

Figure 34:
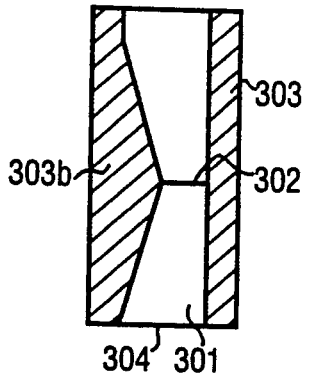
FIG. 34 is a sectional view of a third modification of the embodiment of FIG. 24.
Figure 35:
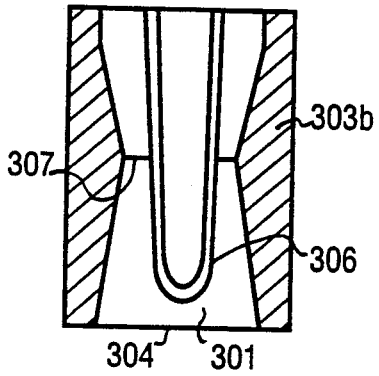
FIG. 35 is a sectional view of a third modification of the embodiment of FIG. 28.

FIGS. 34–36 illustrates modifications of the embodiments of FIGS. 24, 28 and 31, respectively wherein the mirror images of the flow control devices of the latter Figures extend distally from the liquid inlet ports. As required the wall portions of either the peripheral walls or the flow control devices will comprise porous portions. The configuration of the foam dispensing device, either that of FIG. 1 or 23, will depend upon the locations of said wall portions and the means of connecting them to the pressurized gas source.

It is to be understood that all opposite or porous walls may be tapered, or not, in accordance with the user's requirements.

Furthermore, the orifice sizes and choices of permeable as well as other materials of construction will also depend upon the operator's needs as well as compatability considerations.

The invention having been described with respect to specific embodiments thereof it is to be understood that variations and modifications may be made therein without departing from the scope of the invention.

I claim:

1. A device for producing foams, by admixing foamable liquids and gases, comprising a hollow mixing chamber comprising a peripheral side wall and a proximal opening through which said foams are discharged; inlet means for passing foamable liquids from a source therefor into said mixing chamber; and porous means situated between said opening and said inlet means for passing said gases only, from a source therefor, into said mixing chamber transversely to said foamable liquids; and means within said mixing chamber to control the flow of foamable liquids therein.

2. The device of claim 1 wherein said flow control means comprises a first tapered wall portion separating said inlet means and discharge opening the taper being so directed that the wall opposite said tapered wall is spaced further therefrom near said discharge opening than near the inlet means.

3. The device of claim 2 wherein said first tapered wall portion comprises a portion of the inner surface of said peripheral wall.

4. The device of claim 3 wherein said gas permeable porous means comprises a portion of the peripheral wall opposite said first tapered wall portion.

5. The device of claim 3 wherein said gas permeable porous means comprises a portion of said first tapered wall.

6. The device of claim 3 comprising a second tapered wall portion extending distally from said first tapered wall portion and tapering in the opposite manner to the first tapered wall portion.

7. The device of claim 2 wherein said flow control means comprises an elongated body, a portion of which is situated within, and spaced from, the peripheral wall of said mixing chamber.

8. The device of claim 7 wherein the inner portion of the peripheral wall between said inlet means and discharge opening is tapered so that the flow control means is further spaced from the peripheral wall near said discharge opening than near said inlet means.

9. The device of claim 8 wherein a section of the tapered wall within the mixing chamber is hollow and a portion of said hollow section, in fluid connection with a gas source, comprises said gas permeable porous means.

10. The device of claim 8 wherein said elongated body, in fluid connection with a gas source, is hollow and portion of the section thereof within the mixing chamber comprises said gas permeable porous means.

11. The device of claim 8 wherein said elongated body and tapered wall portion extend distally from said inlet means and where said distal tapered wall portion tapers in the opposite manner to the portion thereof extending proximally from the inlet means.

12. The device of claim 7 wherein said elongated body is tapered within the mixing chamber so that it is further spaced from the peripheral wall near said discharge opening than near said inlet means.

13. The device of claim 12 wherein a portion of the peripheral wall within the mixing chamber is hollow and comprises said gas permeable porous means said porous means further being in fluid connection with said gas source.

14. The device of claim 12 wherein said elongated body is hollow and a portion thereof, in fluid connection with said gas source, within the mixing chamber comprises said gas permeable porous means.

15. The device of claim 12 wherein said elongated body extends distally from said inlet means and wherein the tapered portion of said extension tapers in the opposite manner to the portion thereof extending proximally from the inlet means.

16. The device of claim 1 further comprising first connecting means to provide fluid connection between the inlet means of the mixing chamber and a source for the foamable liquid.

17. The device of claim 16 wherein said first connecting means comprises a hollow tube extending distally from the peripheral side wall of said mixing chamber to said foamable liquid source.

18. The device of claim 1 further comprising a foamable liquid source comprising an opening closed by a cap wherein said cap comprises inlet means in fluid connection with a pressurized gas source and outlet means in fluid connection with said mixing chamber.

19. The foam producing device of claim 1 for use in the alternative dispensing of foams or liquids, wherein said porous means comprising:

a) a porous element comprising:
   1) a partially gas permeable wall;
   2) a gas distributing plenum or chamber; and
   3) a gas entry port in fluid connection with said plenum and pressurized gas supply means;
b) a second wall opposite the outer surface of said gas permeable wall;
c) a mixing chamber comprising:
   1) at one end, the proximal end, a small annular opening between said gas permeable wall and said second wall, comprising an orifice for the uniform distribution of foamable liquids therethrough and into said chamber; and
   2) at the distal end an exit port for the discharge of foams or liquids from said chamber;
d) a liquid supply element comprising:
   1) a liquid distribution plenum for the uniform distribution of said foamable liquids to said orifice; and
   2) a liquid entry port in fluid connection with said plenum and a pressurized foamable liquid supply:
e) pressurized gas supply means comprising:
   1) a reservoir for said gas,
   2) conduit means between, and in fluid connection with, said reservoir and said gas entry port: and
f) foamable liquid supply means comprising:
   1) a reservoir for said foamable liquid:
   2) conduit means between, and in fluid connection with, said reservoir and said liquid entry port: with the proviso that only the portion of said gas permeable wall between said orifice and said exit port is gas permeable.

20. The device of claim 19 wherein said chamber is tapered the distance between said gas permeable wall and said second wall increasing with increasing distance from said orifice towards said discharge port.

21. The device of claim 20 wherein the gas permeable wall is tapered.

22. The device of claim 20 wherein the second wall is tapered.

23. The device of claim 19 wherein the second wall and the gas permeable wall are approximately parallel.

24. The device of claim 19 further comprising valve means to control the entrance of said pressurized gas to said gas distribution plenum said valve means being closed when only dispensing of the liquid is desired.

25. The device of claim 19, comprising:

a) means comprising a horizontal first wall comprising:
   1) a port through which passes a pressurized gas inlet tube;
   2) an annular second wall descending vertically therefrom comprising a port through which passes a liquid inlet tube, said wall further terminating in a discharge port at its lower end;
b) a gas transmission tube passing through the port of said first wall and the gas inlet port of the porous element, said tube being in fluid connection with the pressurized gas supply and delivery means; and
c) a liquid transmission tube passing through the port in said second wall to dispense foamable liquid through an orifice between said second wall and the wall of the porous element.

26. The foam producing device according to claim 25 wherein said foamable liquid supply means comprises a large first container comprising a discharge port closed by a cap comprising:

a) a gas inlet port therethrough from which vertically rises a gas inlet tube in fluid connection with a pressurized gas source;
b) a liquid outlet port therethrough from which vertically rises a liquid outlet tube in fluid connection with the foam producing device and the inner container;
c) a tubular element inwardly spaced from the wall of said large container and descending from the bottom wall of said cap said tube defining an inner second container said tube comprising at its lower end a port for liquid connection with said first container and a one-way valve for closing of said port when the pressure within said second container is greater than within the first container; and
d) a small third tube, within said second container, descending vertically from the bottom of * and said cap * spaced inwardly from the wall of said inner container and outwardly from the liquid outlet port and defining a liquid conduit in liquid connection at its upper end with the liquid outlet means and having an opening in its lower end for liquid connection with said second container.

27. The foam producing device according to claim 25 wherein said pressurized gas supply and delivery means comprises:

a) a pressurized gas source;
b) a tube in fluid connection with said source comprising at least two branches wherein 1) a first branch is in fluid connection with the gas inlet tube of the liquid delivery means; and
2) a second branch is in fluid connection with the gas inlet tube of the foam producing device said second branch comprising valve means to prevent delivery of gas to said foam producing device when only dispensing of liquid is desired.

28. The foam producing device according to claim 27 wherein said valve is selected from the group consisting of two - and three - way valves.

29. The foam producing device according to claim 28 wherein said valve is a two - way valve placed in the branch in fluid connection with the porous element downstream of the branching point.

30. The foam producing device according to claim 28 wherein said branching point comprises a three - way valve.

31. The foam producing device according to claim 19 comprising:

a) means comprising
1) a horizontal base comprising:
i) a first wall rising vertically therefrom;
ii) a second wall rising vertically therefrom and spaced inwardly from said first wall to provide a seat for a porous element;
iii) a first port spaced inwardly from said second wall and off center for transmission of foam producing gas;
iv) at least one second port spaced between said first and second walls for transmission of foamable liquid;
v) a partial ring extending horizontally outward from said first wall one or the other of the ends of which, as desired, is to engage a tab in a flow control base;

b) a porous element which seats upon said second wall comprising said partially porous wall comprising:
1) a non-porous base comprising a gas entry port;
2) a non-porous end opposite thereto; and
3) a porous portion therebetween; said partially porous wall flaring from said base and said non-porous opposite end towards said first wall of said housing to form a small annular orifice between said wall at the point of closest approach therebetween wherein the wall of said porous element is non-porous from the base thereof to slightly beyond said orifice;

c) a fluid control base within which the base of said housing may rotate comprising a horizontal wall comprising:
1) an annular vertical wall rising therefrom, whose inner diameter is approximately equal to the outer diameter of the horizontal wall of said housing at its largest, from which a horizontal tab extends inward;
2) a gas transmission port spaced inwardly from said wall and off center;
3) a least one liquid transmission port spaced between said gas transmission port and said wall; and
4) an annular wall descending vertically therefrom between said gas and liquid transmission ports in which there is inserted and from which there descends vertically a hollow tube comprising a gas delivery conduit in the opposite end of which is inserted a one-way said valve which opens when the pressure outside said conduit is greater than inside; said horizontal base being rotatable to engage one or the other ends of the partial horizontal ring thereof with the lip of the flow control base, as desired, for alternative discharge of liquids or foams.

32. The foam producing device according to claim 31 wherein said air and foamable liquid supply and delivery means comprises a flexible or semi-rigid container comprising:

a) a neck comprising a discharge port within which an assembly comprising said horizontal base, porous element and flow control base is inserted;
b) a cap to retain said assembly in place;

wherein when said container is inverted so that the second end in said conduit is above the foamable liquid level, the container is squeezed thereby causing the one-way valve to open allowing air to enter the conduit and the housing is rotated within said flow control base to engage said lip and a first end of the partial ring of said horizontal base whereby all of the liquid transmission ports are aligned to allow foamable liquid to flow through said orifice and over said porous element to be discharged as a liquid; or, if desired, the lip and the second end of the partial ring of said horizontal base are engaged whereby all of the gas and liquid transmission ports are opened thereby also allowing air to enter the porous element and permeate therethrough to mix with foamable liquid passing over said element to form foams for discharge.

33. The foam production device according to claim 32 wherein the base of said horizontal base and said fluid control base each comprises at least three gas transmission ports equally spaced from each other wherein the liquid transmission ports of both bases are aligned in the liquid dispensing mode.

34. The foam production device according to claim 33 wherein the gas transmission ports of the porous element, horizontal base and fluid control base are also aligned in the foam dispensing mode.

35. A device for producing foams, by admixing foamable liquids and gases, comprising a hollow mixing chamber, having a peripheral side wall and a proximal opening through which said foams are discharged; inlet means for passing said foamable liquids from a liquid source therefor into said mixing chamber; porous means, situated between said opening and said inlet means for passing said gases, from a gas source therefor, into said mixing chamber; and the foamable liquid source comprising a container with an opening closed by a cap and wherein said cap comprises inlet means in fluid connection with a pressurized gas source and outlet means in fluid connection with said mixing chamber;

said mixing chamber being situated within said container on the distal side of the cap, and comprising a proximal hollow extension passing through the outlet port of said container, said extension being terminated at its proximal end by an opening for discharge of the foam, and a distal extension comprising a hollow tube in fluid connection with the inlet means of the mixing chamber and a portion of the peripheral wall of the mixing chamber comprising said gas permeable porous means which is in fluid connection with both the mixing chamber and container, whereby a portion of the pressurized gas passing into the container enters the mixing chamber to mix with the foamable liquid entering thereinto through the inlet means thereof.

36. A foam dispensing device comprising:

a) a foam generating device for producing foams by admixing foamable liquids and gases wherein said device comprises a hollow mixing chamber comprising a peripheral side wall and a proximal opening through which said foams are discharged; inlet means for passing said foamable liquids from a source therefor into said mixing chamber and porous means for passing said gases only from a source therefor into said mixing chamber transversely to said foamable liquids, wherein said porous means is situated between said proximal opening and liquid inlet means; and b) a foamable liquid source comprising a container with an opening closed by a cap and wherein said cap comprises inlet means in fluid connection with a pressurized gas source and outlet means in fluid connection with said mixing chamber.

37. A foam dispensing device comprising; a foam generating device for producing foams by admixing foamable liquids and gases wherein said device comprises a hollow mixing chamber having a peripheral side wall and a proximal opening through which said foams are discharged; inlet means for passing said foamable liquids from a source therefor into said mixing chamber and porous means for passing said gases from a source therefor into said mixing chamber and wherein said porous means is situated between said proximal opening and liquid inlet means; a foamable liquid source comprising a container with an opening closed by a cap and wherein said cap comprises inlet means in fluid connection with a pressurized gas source and outlet means in fluid connection with said mixing chamber; said mixing chamber being situated within said container on the distal side of the cap, and comprising a proximal hollow extension passing through the outlet port of said container, said extension being terminated at its proximal end by an opening for discharge of the foam, a distal extension comprising a hollow tube in fluid connection with the inlet means of the mixing chamber and a portion of the peripheral wall of the mixing chamber comprising said gas permeable porous means which is in fluid connection with both the mixing chamber and container, whereby a portion of the pressurized gas passing into the container enters the mixing chamber to mix with the foamable liquid entering thereinto through the inlet means therefor.

* * * * *